United States Patent [19]

Morris et al.

[11] Patent Number: 4,580,300

[45] Date of Patent: Apr. 8, 1986

[54] COMBINED WALL CONSTRUCTION FORM AND PLUMBING FIXTURE MOUNTING DEVICE FOR FIRE RATED WALL CONSTRUCTION

[75] Inventors: Earl L. Morris, La Habra Heights; V. Walter Hafner, Whittier; Theodore J. Sally, Graton, all of Calif.

[73] Assignee: Acorn Engineering Company, City of Industry, Calif.

[21] Appl. No.: 421,078

[22] Filed: Sep. 22, 1982

[51] Int. Cl.[4] ..... E03D 11/00

[52] U.S. Cl. ..... 4/252 R; 4/419; 4/661; 4/DIG. 15; 52/213; 52/215; 52/714

[58] Field of Search ..... 4/252 R, 661, 419, 626, 4/648–649, 631, 663, 664, DIG. 15; 52/715, 714, 211, 213, 220, 215, 221

[56] References Cited

U.S. PATENT DOCUMENTS

| | | | |
|---|---|---|---|
| 1,361,586 | 12/1920 | Johnson | 52/715 X |
| 1,507,331 | 9/1924 | Bulman | 4/242 R |
| 1,646,312 | 10/1927 | Perkins et al. | 52/714 |
| 1,704,717 | 3/1929 | Baum | 52/213 X |
| 1,712,019 | 5/1929 | Baum | 52/213 X |
| 1,819,512 | 8/1931 | Isaacson | 52/215 X |
| 1,996,693 | 4/1935 | Wallace | 4/252 R |
| 2,652,907 | 9/1953 | Miller | 52/211 |
| 2,684,518 | 7/1954 | Whitlock | 4/252 R X |
| 2,728,126 | 12/1955 | Whitlock | 4/252 R X |
| 3,129,437 | 4/1964 | McClanahan | 4/252 R |
| 3,435,467 | 4/1969 | Flegel et al. | 4/252 R |
| 3,495,283 | 2/1970 | Studer | 4/252 R |
| 3,701,172 | 10/1972 | McClanahan | 4/252 R |
| 3,932,899 | 1/1976 | Brady et al. | 4/252 R |
| 3,942,201 | 3/1976 | Morris et al. | 4/252 R |

OTHER PUBLICATIONS

Roblin Architectural Drawing (Anchors for Frames in Masonry Walls)–R–1 C–10.

*Primary Examiner*—Henry K. Artis
*Attorney, Agent, or Firm*—Edgar W. Averill, Jr.

[57] ABSTRACT

A security sleeve for facilitating the mounting of plumbing fixtures in fire rated masonry or concrete wall construction. The sleeve has a pair of metal plates which are spaced apart about the thickness of the wall. The plates have a plurality of holes which correspond with a plurality of conduits bridging the metal plates to form passageways for plumbing pipes and fasteners connected to the plumbing fixture.

10 Claims, 5 Drawing Figures

COMBINED WALL CONSTRUCTION FORM AND PLUMBING FIXTURE MOUNTING DEVICE FOR FIRE RATED WALL CONSTRUCTION

BACKGROUND OF THE INVENTION

The field of the invention is devices for facilitating the secure attachment of plumbing fixtures to concrete block and poured concrete walls. The invention relates more particularly to the mounting of plumbing fixtures in prisons, mental institutions and other locations where it is essential that the fixtures be secured in such a manner that it is virtually impossible to remove them from the wall. It is also important in such environments that the mounting device not provide any means of escape and also that it provide a highly fire retardant barrier.

In the past a common method of mounting plumbing fixtures was to cut holes through a concrete block or concrete wall and pass the pipes and bolt the fixtures through such holes. Such a method was of course very time consuming and thus expensive. A better method of mounting such fixtures is shown in U.S. Pat. No. 3,701,172 (McClenahan). It often occurred that when concrete was poured against the inner face of the plate that the pipes which were held to the plate were knocked out of line therby providing an imperfect opening.

A further improvement in the field is disclosed in U.S. Pat. No. 3,942,201 (Morris et al.). This wall sleeve provided the necessary strength but was not suitable for fire rated walls because of its open interior.

SUMMARY OF THE INVENTION

It is an object of the present invention to provide a device for securely mounting plumbing fixtures in a poured concrete or masonry wall in a manner which provides a highly secure attachment as well as a fire rated wall.

The present invention is for a fixture mounting unit for wall mounted plumbing fixtures which can be used both in conjunction with masonry or poured concrete wall installations. The fixture has a pair of spaced apart mounting plates each having a plurality of holes each of which match a hole in the other plate. A plurality of conduits are secured to the plates at the matching holes and the two plates are held securely together. In a preferred embodiment, a pair of channels are affixed to the mounting plates along their vertical sides to hold the plates parallel to one another. To further lock the fixture into the wall, the channel may have its edges facing outwardly away from the center of the fixture. To even further lock the fixture into a wall, "C" shaped channels may be used. In an alternate embodiment one of the conduits is substantially larger than the others and a closure cap may be affixed to one of the plates to hold a fire-retardent material within the inside of the body of the largest conduit. To still further secure the unit to a wall, the base of the channels have one or more openings to permit cement or concrete to pass therethrough to further cause the unit to become a part of the wall. Still further attachment to a masory wall may be provided by a plurality of masonry anchors held to the unit. The mounting plates can be used as a form for pouring concrete in a portion of a block wall. Alternatively, nail holes are provided so that the same fixture may be readily held within the form for a poured concrete wall.

Fiducial marks are positioned about the fixture to assist in correct placement.

DESCRIPTION OF THE PREFERRED EMBODIMENTS

Figure 3:
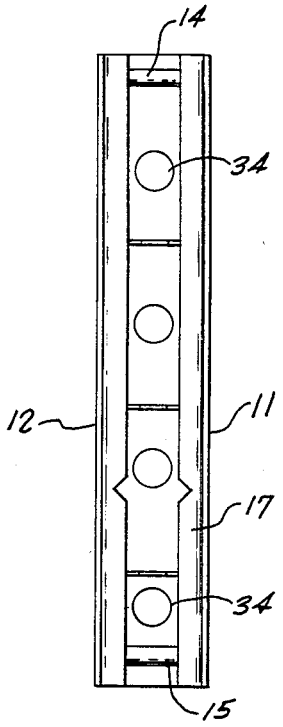
FIG. 3 is a side view thereof.
Figure 2:
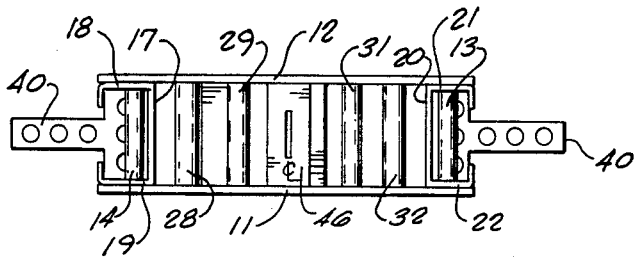
FIG. 2 is a top view of the sleeve of FIG. 1.
Figure 1:
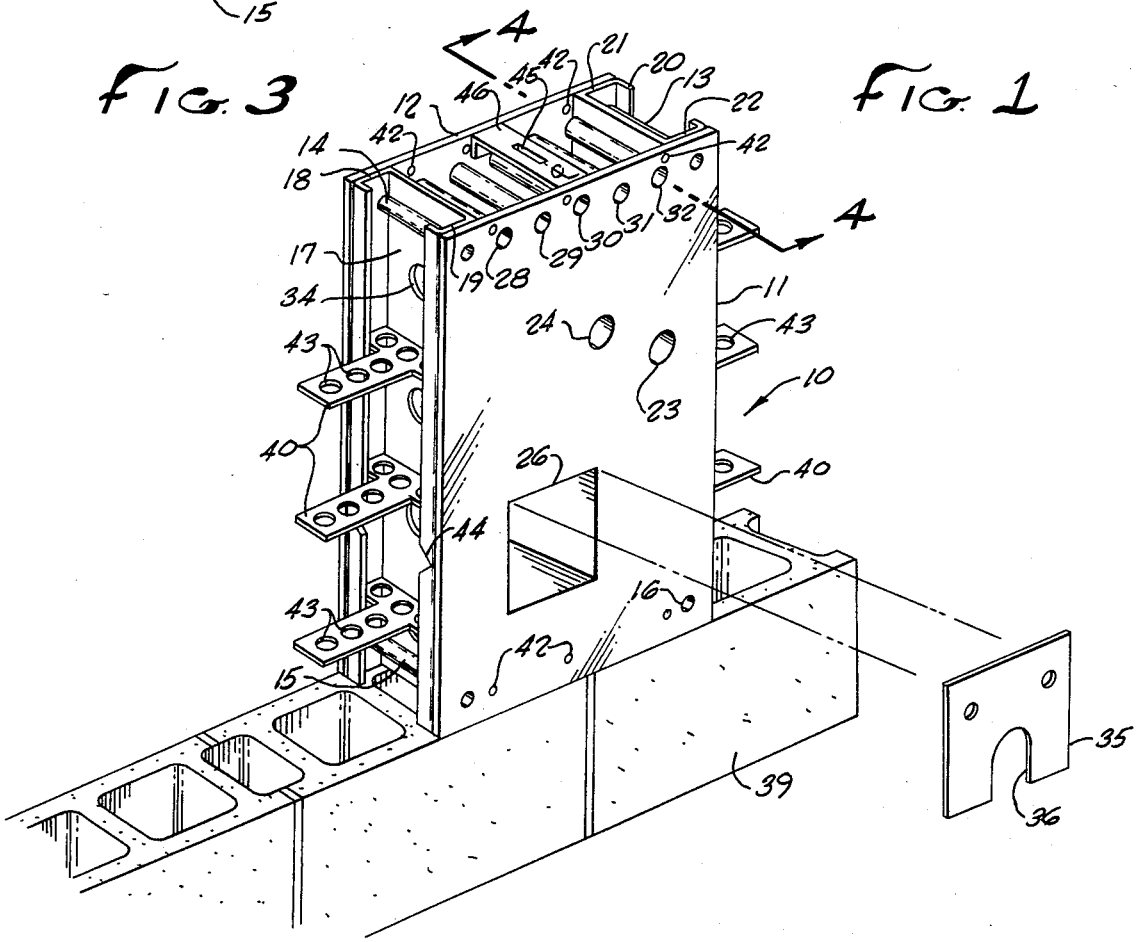
FIG. 1 is a perspective view of the security sleeve of the present invention shown on a course of concrete blocks.

It has become recognized that it is necessary to bolt plumbing fixtures to a concrete or masonry wall in order to achieve maximum strength and security. It has also been recognized that by the use of sleeves that the appropriate holes for such bolting and for plumbing may be more quickly and more accurately spaced within and through the wall. The sleeve of the present invention is indicated generally by reference character 10 and consists of a first rectangular metal plate having a plurality of openings for the attachment of tubes 13, 14, 15, 16, 23–25, and 28–32. Galvanized metal of 16 gauge is a satisfactory material of construction. A square conduit 26 is also affixed to plate 11. A second metal plate 12 has a matching set of openings likewise for the attachment of the above-referenced tubes. A pair of "C" shaped channel members 17 and 20 are securely affixed to plates 11 and 12 to form an exceptionally strong unit. Channel members 17 and 20 have arms 18, 19, 21 and 22 respectively which are "L" shaped to form the "C" shaped channels. While "U" shaped channels can be used, a "C" shaped channel has the advantage of providing a slideable holding slot for a plurality of masonry anchors 40 which further secures the unit to the wall. The channel members are preferably positioned so that they are facing outwardly to assist in locking the unit into the finished wall as described below. While channel members are the preferred method of holding the plates 11 and 12 together, other means may be used such as a plurality of straps. It is important, however, that the means for holding the plates together be permanent and secure.

When the unit is used in conjunction with a concrete block wall, the fixture not only acts as a jig to position the conduits but also serves as a form. It is thus no longer necessary to go to the time and expense of framing and forming that area of a block wall which contains the fixture of the present invention. The unit is filled through the open top with poured concrete or wet grout. Plates 11 and 12 hold concrete or grout within the unit and concrete within the channel members 17 and 20 extends outwardly to fill the space between the fixture and the masonry blocks along each side and along the fixture. The unit thus becomes a homogeneous part of the wall. The channels along the sides and the connecting tubes lock the sleeve in place. While "U" shaped channels perform well, "C" shaped channels form an exceptionally secure lock in the concrete.

Figure 4:
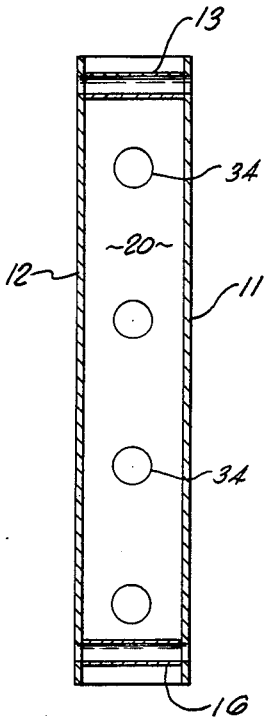
FIG. 4 is a cross-sectional view taken along line 4—4 of FIG. 1.
Figure 5:
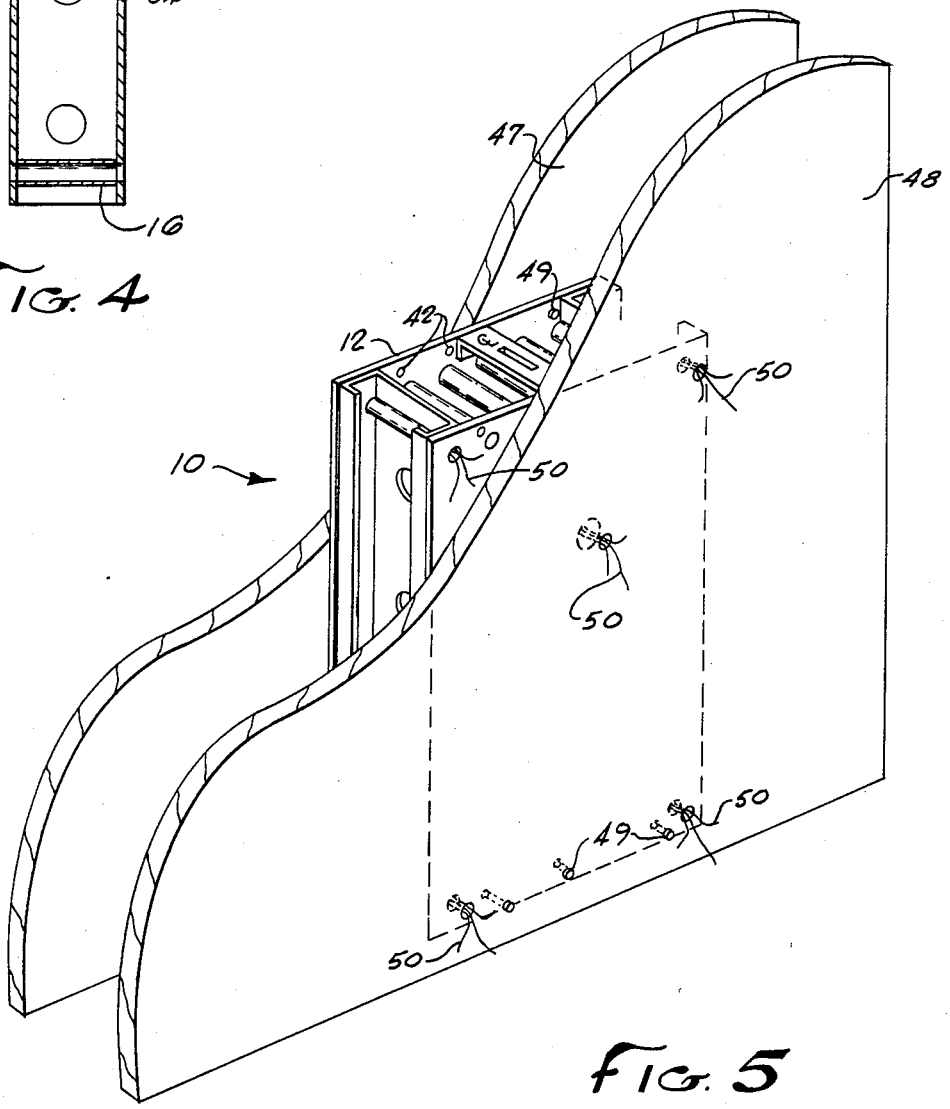
FIG. 5 is a perspective view of the security sleeve of FIG. 1 shown affixed to a form (partially cut away) for a poured concrete wall.

When the unit is used in conjunction with poured concrete walls, nail holes 42 are used to attach the fixture to the concrete forms. As shown in FIG. 4, plywood forms 47 and 48 comprise the sides of a form for a poured concrete wall. Sleeve 10 is first nailed to form 47 to hold the sleeve in place, nail 49 showing in the cut-away portion of FIG. 5. Next, form 48 is affixed and may be readily held by a plurality of wire ties 50 which can pass through the tubes of the sleeve. After the concrete is set, the forms are removed and the protruding nail shanks are cut off. Thus, the unit of the present invention is advantageously used both with poured concrete walls and with block wall construction.

To still further facilitate the formation of a totally integrated unit, a plurality of openings 34 are formed through the channels so that the open top of the unit may be filled with concrete which then flows to fill the interior of the unit and also flows from within the unit into the space within the edge of the channel members and the cement blocks forming an exceptionally solid and secure unit. When used in poured concrete walls, openings 34 further facilitate complete filling. Still further, the masonry anchors 40 may be provided with one or more holes 43 which can be used to pass reinforcing bars therethrough.

In the correct placement of a plumbing fixture such as a toilet bowl in a wall, the contractor is typically given two reference measurements. One is the vertical center of the bowl and the other is the height of the bowl. In order to facilitate the correct placement of the fixture of the present invention with respect to these reference measurements, fiducial marks or notches 44 are formed in channel members 17 and 20 in the plane which corresponds to the final height of the toilet bowl. Fiducial mark 45 is formed in handle 46 at the vertical center line of the toilet bowl or other fixtures being mounted.

To further illustrate the invention, the particular tubes passing through the sleeve are used as follows. Tubes 13, 14, 15 and 16 are used for bolting fixtures to the wall and bolts pass through these tubes. Tubes 28, 29, 30, 31 and 32 are used for the passage of control rods for valves and the like and tubes 23, and 24 are used for water pipes and drain pipes. The large conduit 26 is used for passage of the toilet waste outlet and the toilet fixture mounting hardware not shown. The design of the present invention provides a fixture mounting base with strength and fire rating equivalent to the wall itself. The small tubes provide positive security under all conditions and when used in fire rated walls, they can be easily packed with glass fibers or other fireproof materials acceptable to fire authorities having jurisdiction. Optional waste opening cover 35 has a notch 36 which may slipped over the waste pipe and held to the fixture by the plumbing mounting hardware not shown. Plate 35 has a notched portion 36 which passes over the waste outlet pipe.

It can be seen that by providing a base which is flat and at right angles to the vertical planes of the sides, that the unit becomes free-standing and may be simply placed on the lower course of concrete blocks without the necessity of providing any support. The conduits passing through the unit may be made as small as necessary to carry out the desired function because the holes are accurately positioned and designed to cooperate with the units to be mounted.

Although large conduit 26 is shown as a square conduit it can, of course, be rectangular, circular or other shape depending upon the desired end use. While rectangular mounting plates are shown, other shapes may be used as long as they are securely held together.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A combined wall construction form and plumbing fixture mounting device for use in poured concrete or block walls comprising:

a first wall surface facing metal plate having a plurality of openings passing therethrough at which conduits are securely affixed, said openings corresponding in size and location to the desired size and location of the plumbing and fastening means to be mounted on the fixture, said first metal plate having vertical sides extending from the top to the bottom thereof and a horizontal base along the bottom side of said first plate;

a plurality of conduits securely affixed to said first wall-surface-facing plate at each opening;

a second wall surface facing metal plate having a plurality of openings which match the openings in the first plate, said conduits also being securely affixed to the second metal plate at the location of each opening therein and said second plate being held so that is is parallel to the first plate and separated from said first plate a distance about equal to the thickness of the wall in which the form is to be used, said second metal plate having vertical sides extending from the top to the bottom thereof and a horizontal base along the bottom of said second plate; and support means comprising outwardly facing "C" shaped channel means securely affixed to said first wall surface facing metal plate and said second wall surface facing metal plate along the vertical sides thereof to hold the plates in a parallel manner with respect to each other.

2. The combined wall construction form and plumbing fixture mounting device of claim 1 further including at least one "T" shaped masonry anchor held in a least one of said "C" shaped channel members.

3. The combined wall construction form and plumbing fixture mounting device of claim 2 wherein the outwardly extending portion of the "T" shaped masonry anchor has a plurality of openings therethrough.

4. The combined wall construction form and plumbing fixture mounting device of claim 1 wherein at least one of said channel members has at least one opening therethrough to permit the flow of concrete therethrough.

5. The combined wall construction form and plumbing fixture mounting device of claim 1 wherein each of said channel members has at least one opening therethrough to permit the flow of concrete therethrough.

6. The combined wall construction form and plumbing fixture mounting device of claim 1 wherein one of said conduits is substantially larger than the other conduits and further including a cover plate affixed to said first metal plate whereby insulation material may be held within said one of said conduits.

7. The fixture of claim 1 further including a handle having a fiducial mark thereon.

8. The fixture of claim 1 wherein one of said channel members has a fiducial mark thereon.

9. The fixture of claim 1 further including a fiducial mark on the edge of each "C" shaped channel member.

10. The fixture of claim 1 further including a plurality of nail holes near the edges of said first and second metal plates.

* * * * *